United States Patent [19]

Baker

[11] 4,365,543

[45] Dec. 28, 1982

[54] LINING SYSTEM FOR CHIMNEYS AND DUCTS

[76] Inventor: Maurice R. Baker, 2472 Callum Ave., Mississauga, Ontario, Canada, L5B 2H9

[21] Appl. No.: 188,220

[22] Filed: Sep. 17, 1980

[51] Int. Cl.[3] ..... F23L 17/02

[52] U.S. Cl. ..... 98/58; 110/160; 110/184

[58] Field of Search ..... 52/218; 98/58, 60; 110/184, 160, 161, 162

[56] References Cited

U.S. PATENT DOCUMENTS

| | | | |
|---|---|---|---|
| 144,586 | 11/1873 | Wingate | 110/160 X |
| 3,670,666 | 6/1972 | Herman | 110/160 X |
| 3,693,883 | 9/1972 | Stigger | 98/58 |
| 3,706,290 | 12/1972 | Holland | 98/58 X |
| 3,817,162 | 6/1974 | Guelph | 98/58 |
| 4,216,709 | 8/1980 | Bottenbruch | 110/184 |

FOREIGN PATENT DOCUMENTS

| | | | |
|---|---|---|---|
| 12878 | 8/1903 | Denmark | 110/161 |
| 386113 | 9/1973 | U.S.S.R. | 52/218 |

*Primary Examiner*—William E. Wayner
*Assistant Examiner*—Harold Joyce

[57] ABSTRACT

There is provided a method of constructing a chimney or duct, which comprises an external structural wall, a protective layer of moving air adjacent to and inwardly therefrom, and curved ring devices situated in the gas stream which by their shape control the gas flow and prevent the breakdown of the layer of protective air.

2 Claims, 4 Drawing Figures

LINING SYSTEM FOR CHIMNEYS AND DUCTS

This invention relates generally to chimneys and waste gas ducts of all sizes and for all uses. More generally, the principle of this invention is applicable to fluid carrying conduits of various kinds.

In the specific case of chimneys and ducts which carry hot or corrosive waste gas, there is generally the provision of an interior lining of brick, steel, stainless steel, refractory, plastic, or the like, which has the purpose of protecting the structural wall of the chimney or duct.

It is an aspect of this invention to provide a construction in which this interior lining may be reduced in extent, thickness or resistance to corrosion and heat, and in many installations to dispense with the lining altogether.

This invention provides a system by which the waste gas is kept separated from the structural wall of the chimney or duct by a continuous jacket of air which moves along with the waste gas.

In general, if periferal air inlets were provided at the base of a chimney or the beginning of a duct system, the passage of the waste gas would draw external air inwardly to provide an initial jacket close to the inlets. However, without further control, the gas and air would quickly mix and the jacket or protective effect would be lost. In accordance with this invention, devices are provided at intervals throughout the length of the chimney or duct, which devices control the lateral movement of the waste gas and thereby prevent the breakdown or loss of the air jacket.

In the specific description which follows, it is assumed that the chimney or duct is circular in cross-section, although it would be understood by those skilled in the art that a circular section is not a prerequisite.

In accordance with this invention, there are provided rings (or approximations thereto) of a suitable material, which may be steel, stainless steel, refractory, etc., the rings having a curved radial section (or approximately so) and being placed at or near the intended gas/air interface. These rings may be supported on ribs from the structural wall.

By virtue of the flow of the gas over the curved surface of the ring, the downstream gas (and air) will be directed towards the centre of the flow, thereby compensating for the natural tendency to drift outwardly or radially, and keeping the gas and air separated. At a point downstream of each ring, the inward effect will be dissipated by frictional decay, and at that point, another ring would be provided to reharness the flow of gas.

The air forming the jacket is provided through inlets around the perifery of the chimney or duct at the upstream end thereof (at the bottom, in the case of a chimney), and at other points as required.

In the accompanying drawings

FIG. 1 shows the chimney in association with a power or manufacturing plant, commercial or industrial building or the like.

Essentially, the method of this invention involves the provision of devices with curved ring surfaces which control the outward spread of a column of waste gas, thereby assuring the integrity of a protective jacket of air, also controlled by the devices.

Figure 1:
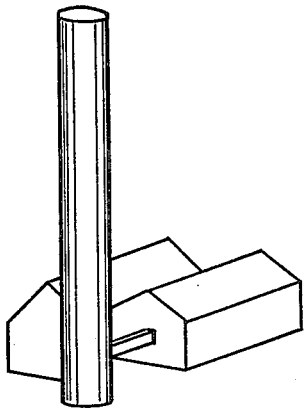
Figure 2:
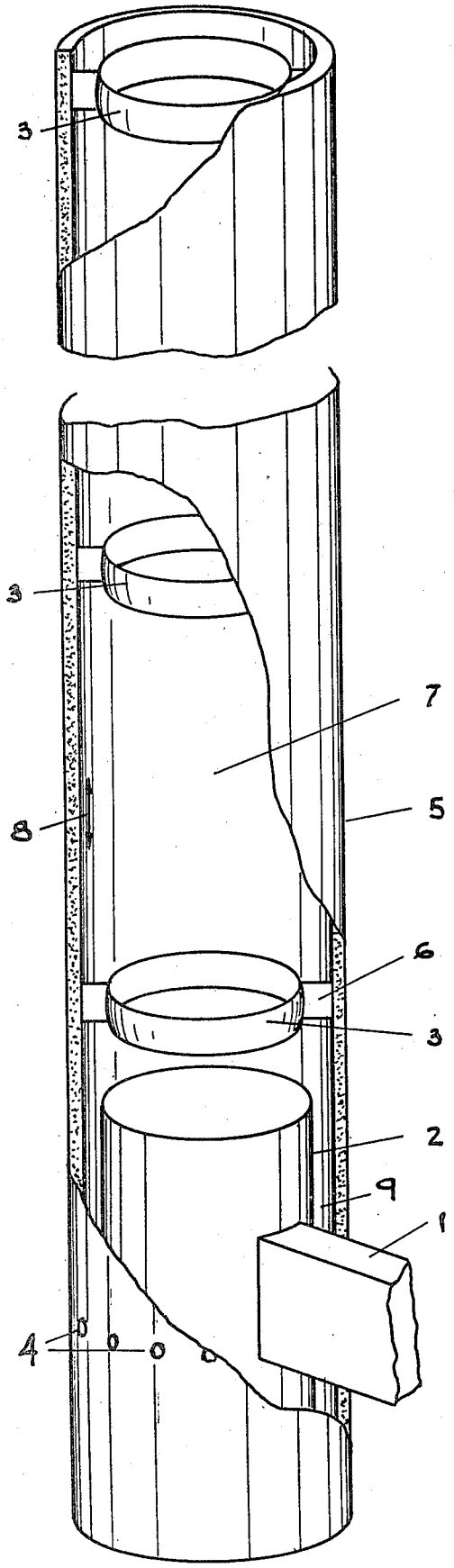
FIG. 2 shows a cut-away view of a chimney of the design of this invention.

In FIG. 2 the chimney is seen to consist of a conventional horizontal duct 1 through which the waste gas enters the chimney, an inner partial lining 2, and a number of ring devices 3 spaced over the height of the chimney, which are secured to the structural wall 5 by ribs 6.

The gas entering the chimney is translated to a vertical motion in the partial lining 2, and is also thereby given a plan shape, (usually circular). At 4 are shown air inlets by which air is drawn into the annular space 9 between partial lining 2 and the chimney wall 5. Further air inlets are provided as necessary throughout the height of the chimney.

The vertical motion of the column of waste gas 7, provided either by thermal lift of the gas, or by inlet pressure, sends the gas through the chimney and over the curved devices 3, which are situated in the chimney at a radius so as to be at or near the interface of the waste gas and air jacket 8. The ring devices 3 are so shaped that the flow of gas/air over them directs the flow towards the centre of the chimney. Thus with even relatively low gas velocity sufficient radially inward movement is provided to contain the gas column 7 and to preserve the integrity of the surrounding air jacket 8, thus obviating the need for expensive traditional lining material.

Figure 3:
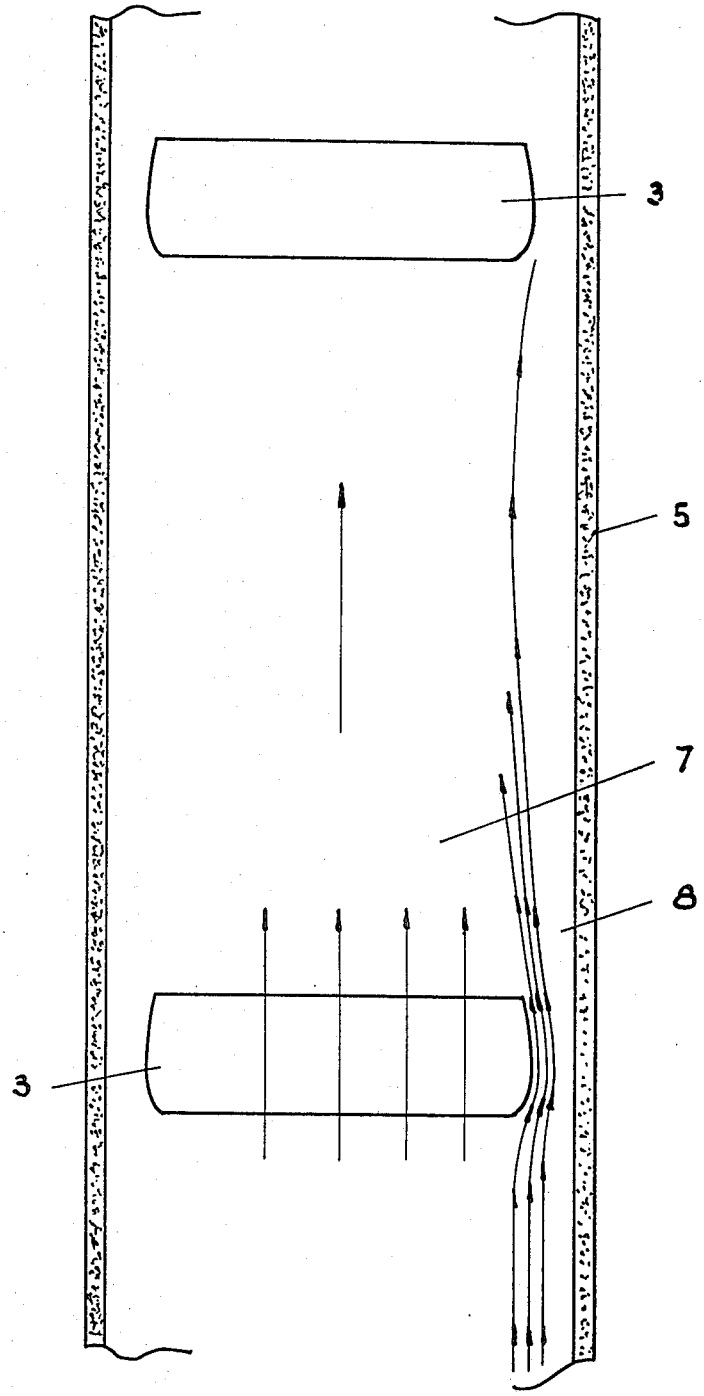
FIG. 3 shows, by flow arrows, the passage of air and waste gas through the chimney of this invention.

In FIG. 3, flow lines of the gas and air are shown in the chimney in association with two of the curved ring devices 3. The periferal gas of the gas column 7, and the air jacket 8, flow over the upstream device and are influenced thereby in terms of velocity, pressure and direction. Someway downstream of that device, the inherent frictional decay will reduce the effects of the device and the gas will return to its entrance condition. At that point another device is provided to reharness the flow. Clearly, in short chimneys it may be necessary to provide only one device.

Figure 4:
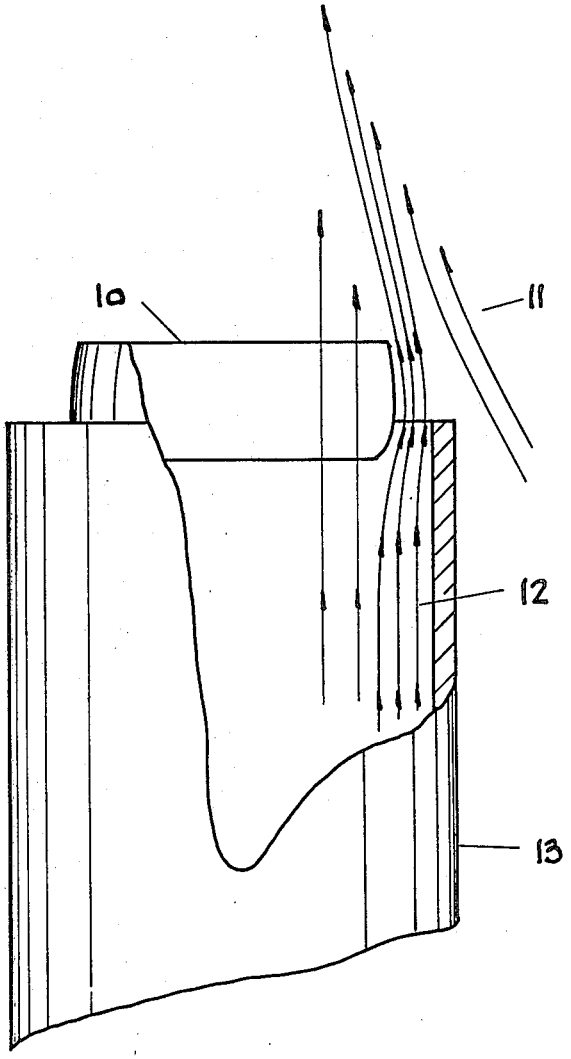
FIG. 4 shows as a second embodiment, an accelerator ring at the top of the chimney.

A second application of the principle of this invention relates to the provision of one or more of the ring devices at the top of a conventional or existing chimney, as shown in FIG. 4. With such provision, the periferal gas 12 from the chimney 13 will be accelerated as it flows over the device 10 and the depression caused will draw ambient air, shown as stream arrows 11, into adjacent and parallel flow. With this arrangement the frictional decaying force will initially be applied to the upwardly moving air 11 surrounding the gas 12, rather than to the gas itself, thus allowing the column of gas to rise higher before dispersal in the atmosphere. In this way a better (i.e. higher) atmospheric diffusion of the gas will be achieved. Alternatively, shorter chimneys can be utilised for a given height for gas dispersal.

The size, shape and interval for the ring devices will be dependent upon the diameter and velocity of the gas column. The size and shape of the devices in the second application will also depend on the gas characteristics. In order to accommodate expected gas velocity variations the profile of the devices can be made to be adjustable.

Although this invention has been described in connection with a 'single flue' chimney, it will be obvious that the invention will apply equally to multi-flue chimneys. Furthermore, the uses of the inventive principle herein described are clearly not limited to chimneys and ducts carrying waste gas. The flow of any gaseous or liquid material can be treated in a similar way, using a neutral fluid surrounding the fluid to be transported. Thus, it is considered that this invention is applicable in general to fluid-carrying conduits.

It will be appreciated that the ring devices, rather than consisting of smoothly curved unitary annuli, can be constructed as conical sections, thus allowing the ring devices to be made from sheet metal, if desired. It would be further possible to construct the ring devices in such a way that a section taken transverse to the axis through the ring device would show a polygonal shape. This again would allow the ring devices to be constructed from initially flat sheet metal.

The embodiment of the invention in which exclusive property or privilage is claimed are defined as follows:

1. A method of constructing a chimney or other fluid carrying conduit comprising the steps, providing an external or structural wall of the chimney or conduit, providing a layer of air, or inert medium, adjacent to the structural wall and inwardly therefrom, which surrounds the effluent gas or other material being passed through the system, providing rings having a curved radial section, or approximately so, at intervals to maintain separation of the gas and air.

2. A method claimed in claim 1, of providing an accelerator ring having a curved radial section, or approximately so, near the top of an existing or conventional chimney, to accelerate the peripheral gas.

* * * * *